United States Patent [19]

Zicko

[11] 4,181,220

[45] Jan. 1, 1980

[54] DISPLAY PACKAGING INSERT

[75] Inventor: James A. Zicko, Natick, Mass.

[73] Assignee: Container Corporation of America, Chicago, Ill.

[21] Appl. No.: 25,183

[22] Filed: Mar. 29, 1979

[51] Int. Cl.[2] ..... B65D 85/20; B65D 81/00

[52] U.S. Cl. ..... 206/315 R; 206/443; 206/486; 211/60 G; 211/60 A

[58] Field of Search ..... 206/315 R, 371, 443, 206/486, 485, 44 R; 229/42, 34 HW, 15; 211/60 G, 60 A, 60 R, 13

[56] References Cited

U.S. PATENT DOCUMENTS

| | | | |
|---|---|---|---|
| 1,158,916 | 11/1915 | Goldsmith | 206/371 |
| 1,897,672 | 2/1933 | Neumann | 229/15 |
| 1,974,674 | 9/1934 | Halladay et al. | 211/60 G |
| 2,253,008 | 8/1941 | Anderson, Jr. | 229/34 HW |
| 2,289,619 | 7/1942 | Anderson, Jr. | 206/315 |
| 2,307,350 | 1/1943 | Anderson, Jr. | 211/60 A |
| 2,460,230 | 1/1949 | Makrianes | 211/60 A |
| 2,629,499 | 2/1953 | Welshenbach | 206/315 |
| 2,645,353 | 7/1953 | Anderson, Jr. | 206/44 R |
| 3,312,232 | 3/1967 | Howell | 206/443 |

*Primary Examiner*—William T. Dixson, Jr.
*Attorney, Agent, or Firm*—Carpenter & Ostis

[57] ABSTRACT

A one piece paperboard packaging insert for displaying and supporting the heads and portions of the shafts of articles such as golf clubs or the like, within an outer package.

1 Claim, 4 Drawing Figures

DISPLAY PACKAGING INSERT

SUMMARY OF THE INVENTION

This invention relates to packaging inserts and primarily to paperboard inserts of the type used to support and display articles such as golf clubs within an outer package.

The structure of the present invention is concerned with a packaging insert which is designed to fit within an outer container at one end thereof, and which has a portion for receiving the heads of golf clubs and another portion which receives the shafts of clubs.

With inserts of this type which are used for display purposes as well as for supporting articles packaged, there is generally printing or advertising material appearing on the insert. Many of the structures of this type are so complex that when folded into erected position, portions of both the upper and lower surfaces of the insert are visible. Thus, in order to have an attractive display, both surfaces must be printed.

It is an object of this invention to provide in an insert structure of the type described, an arrangement whereby only one surface of the insert is exposed to view so that only such one surface need be printed, thereby reducing the cost of manufacture.

This and other objects of the invention will be apparent from an example of the following description and drawings.

THE DRAWINGS

It will be understood that, for purposes of clarity, some elements may have been intentionally omitted from certain views where they are believed to be illustrated to better advantage in other views.

THE DESCRIPTION

Figure 1:
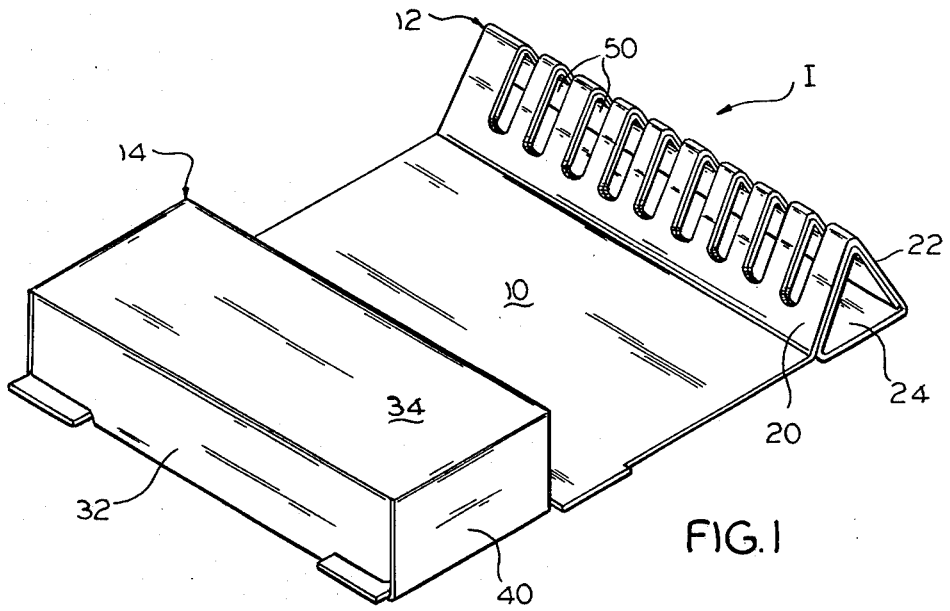
FIG. 1 is a perspective view of a packaging insert embodying features of the invention as shown in the erected condition.
Figure 2:
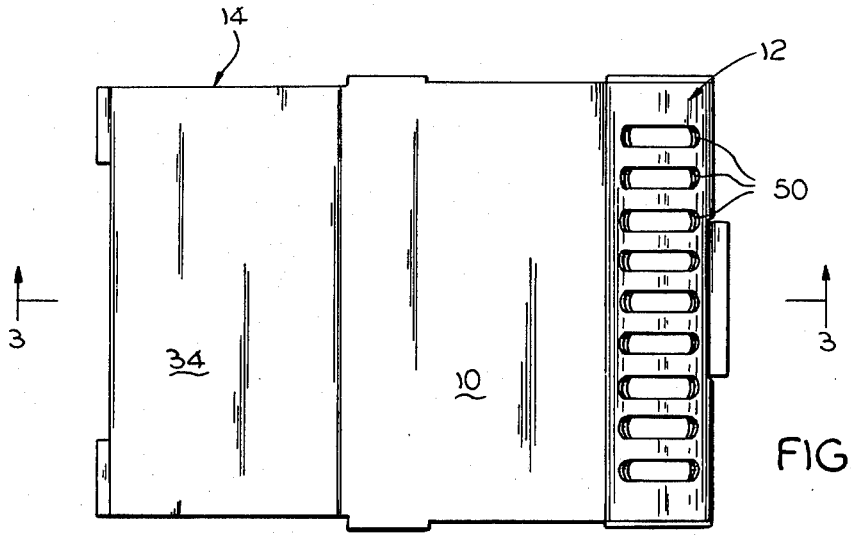
FIG. 2 is a plan view of the structure illustrated in FIG. 1.
Figure 4:
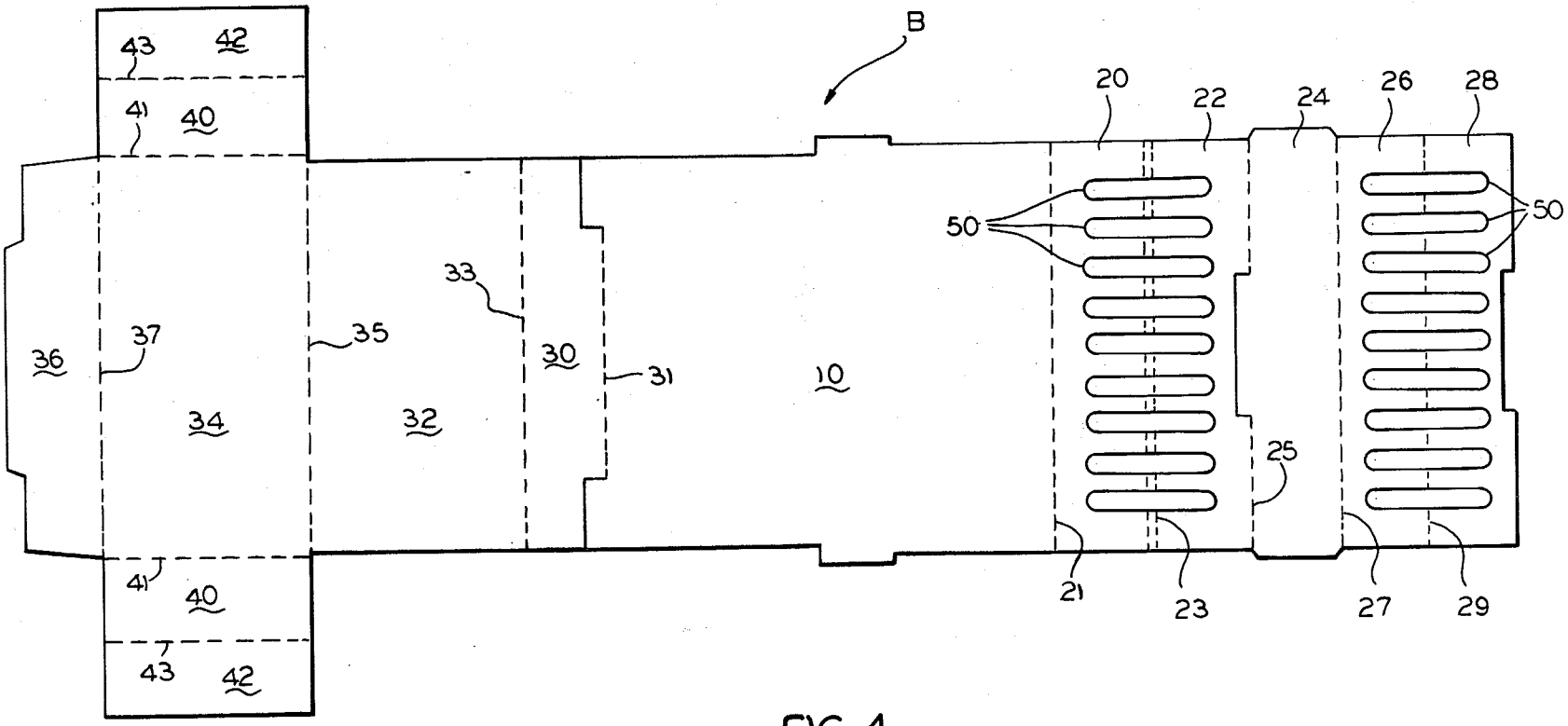
FIG. 4 is a plan view of the blank from which the structure of the other views may be formed.

Referring now to the drawings for a better understanding of the invention, it will be seen that the packaging insert indicated generally at I in FIG. 1, may be formed from a unitary blank B of foldable sheet material such as paperboard illustrated in FIG. 4.

Insert I which has both display and supporting functions, includes a generally rectangular, flat base panel 10, adapted to seat against the inner surface of the bottom wall of an outer container (not shown), adjacent one end thereof.

As best seen in FIG. 1, integrally joined to opposite ends of base panel 10 are a generally triangular golf club shaft supporting structure 12 and a generally box-like head holding structure 14.

Figure 3:
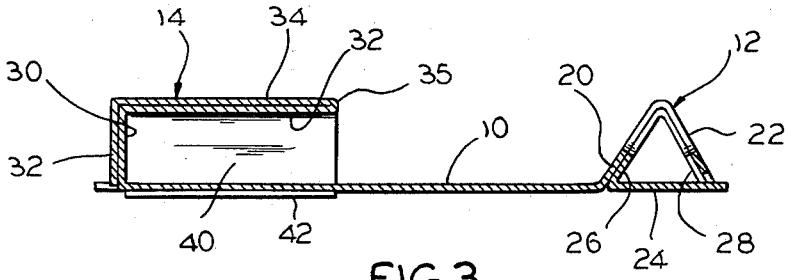
FIG. 3 is a longitudinal, vertical section taken on line 3—3 of FIG. 2.

The shaft supporting structure 12, as best seen in FIGS. 1, 3 and 4, is of a tubular configuration and includes a plurality of relatively narrow, elongated panels 20, 22, 24, 26 and 28 which are foldably joined to one end of base panel 10 and to each other along fold lines 21, 23, 25, 27 and 29, respectively. The panels are folded in face-to-face relation, as best seen in FIG. 3, so that panel 24 serves as a bottom wall, and is aligned with base panel 10 adjacent the end thereof, while panels 20 and 26 form one side wall, and panels 22 and 28 form the other side wall, with the two side walls converging upwardly and being provided with a plurality of aligned, parallel slots 50 which serve to receive portions of the shafts of the supported golf clubs.

At the opposite end of the insert the head holding structure 14 is attached to the base panel 10 and forms therewith a box-like enclosure which is open toward the shaft holding section.

The head holding structure 14 includes a front wall which is spaced above the base panel 10 and foldably joined at its side and end edges to the side and end edges of the base panel 10 by side and end walls.

The front wall includes a pair of inner and outer panels 32 and 34 folded together in face-to-face relation and foldably joined to each other along fold line 35. The side wall includes a pair of inner and outer panels 30 and 36 which have corresponding edges foldably joined along fold lines 33 and 37 to front wall inner and outer panels 32 and 34 respectively. Additionally, the opposite edge of inner side wall 30 is foldably joined along fold line 31 to an edge of base panel 10.

A pair of end walls 40 are foldably joined to opposite ends of front wall outer panel 34 along fold lines 41 and are disposed to extend downwardly to base panel 10. At their opposite edges walls 40 have foldably joined thereto along fold lines 43 retaining flaps 42 which are disposed to be folded at right angles to the end walls and which underlie adjacent portions of base panel 10.

Thus, when the structure is erected, in the manner described, and positioned at one end of a tray type outer container, no glue, staples or other outside securing means are required to maintain the packaging insert in erected condition.

Also, because of the particular configuration and manner in which the elements of the structure are folded together, only one surface of the blank B, from which the insert I is formed, need be printed, as only one surface is visible. This substantially reduces the cost of manufacture and makes the device more practical.

I claim:

1. A one-piece foldable paperboard insert for holding and displaying, within an outer container, portions of articles such as golf clubs or the like, having elongated shafts with integral heads at corresponding ends thereof, comprising:

(a) a flat base panel having integral shaft supporting and head receiving members joined to opposite ends thereof;

(b) said shaft supporting member having a generally tubular structure and including:

(i) a bottom wall co-planar with and disposed adjacent one end of said base panel;

(ii) a pair of side walls having lower edges foldably joined to opposed sides of said bottom wall and converging upwardly therefrom and having upper edges joined to each other;

(iii) said side walls having a plurality of aligned slots defining openings for receiving and supporting portions of said article shafts;

(c) said head receiving member forming with said base panel a box-like structure open toward said shaft supporting member and including:

(i) a front wall spaced above and parallel to said base panel adjacent the other end thereof;

(ii) an end wall and a pair of side walls foldably joining the end and sides of said front wall to said base panel to form an enclosure for receiving said article heads;

(d) said insert being arranged and disposed so that only one surface of the paperboard from which it is formed is visible from one side thereof when the insert is in erected condition.

* * * * *